US010415163B2

(12) United States Patent
Carney

(10) Patent No.: US 10,415,163 B2
(45) Date of Patent: Sep. 17, 2019

(54) SEAMLESS POSTPARTUM GARMENT

(71) Applicant: Ingrid & Isabel, LLC, San Francisco, CA (US)

(72) Inventor: Ingrid Carney, San Francisco, CA (US)

(73) Assignee: Ingrid & Isabel, LLC, San Francisco, CA (US)

( * ) Notice: Subject to any disclaimer, the term of this patent is extended or adjusted under 35 U.S.C. 154(b) by 605 days.

(21) Appl. No.: 14/965,615

(22) Filed: Dec. 10, 2015

(65) Prior Publication Data

US 2017/0164662 A1 Jun. 15, 2017

(51) Int. Cl.

| | |
|---|---|
| ***D04B 1/24*** | (2006.01) |
| ***A41C 1/00*** | (2006.01) |
| ***A41C 1/10*** | (2006.01) |
| ***D04B 1/02*** | (2006.01) |
| ***D04B 1/10*** | (2006.01) |
| *A41C 1/02* | (2006.01) |

(52) U.S. Cl.

CPC ..... *D04B 1/246* (2013.01); *A41C 1/003* (2013.01); *A41C 1/10* (2013.01); *D04B 1/02* (2013.01); *D04B 1/106* (2013.01); *A41B 2500/10* (2013.01); *A41C 1/02* (2013.01)

(58) Field of Classification Search

CPC ..... D04B 1/123; D04B 1/24; D04B 1/246; D04B 1/106; A41B 11/003; A41B 11/005; A41B 11/02; A41B 11/04; A41C 1/003; A41C 1/02; A41D 1/21; A41D 1/215

See application file for complete search history.

(56) References Cited

U.S. PATENT DOCUMENTS

| | | | |
|---|---|---|---|
| 404,163 | A | 5/1889 | Brunner |
| 482,401 | A | 9/1892 | Tynan |
| 514,930 | A | 2/1894 | Heath |
| 818,031 | A | 4/1906 | Kislik |
| 836,136 | A | 11/1906 | Parris |
| 1,380,605 | A | 6/1921 | Swantees et al. |
| 1,389,664 | A | 9/1921 | Jackson et al. |
| 1,608,096 | A | 11/1926 | Friedman |
| 1,609,248 | A | 11/1926 | Harkins et al. |
| 1,683,510 | A | 9/1928 | Wiese |
| 1,753,739 | A | 4/1930 | Burns |

(Continued)

FOREIGN PATENT DOCUMENTS

| | | | |
|---|---|---|---|
| AU | 198168755 | A1 | 10/1981 |
| AU | 200055047 | B2 | 4/2001 |

(Continued)

OTHER PUBLICATIONS

"Cinch Belts". Advertisement for Dorothy Hughes Department Store, Harpers Bazaar, Nov. 1952, p. 98.

(Continued)

*Primary Examiner* — Danny Worrell
(74) *Attorney, Agent, or Firm* — Carr & Ferrell LLP

(57) ABSTRACT

A seamless postpartum garment is disclosed that is formed from a seamless double layer circular knit tube. The garment is flexible and stretchable throughout, and made from at least two different knit structures. Use of different knit structures at strategic locations on the garment, allow for it to provide compression and comfort at strategic locations on a woman's postpartum body.

20 Claims, 7 Drawing Sheets

(56) References Cited

U.S. PATENT DOCUMENTS 1,774,613 A 9/1930 Pidgeon et al.
2,040,058 A 5/1936 Mendel et al.
2,040,657 A 5/1936 Kops et al.
2,224,871 A 12/1940 Kennedy et al.
2,409,601 A 10/1946 Truesdell et al.
2,574,678 A 11/1951 Wilbur et al.
2,579,547 A 12/1951 Cadous
2,606,322 A 8/1952 Vraciu et al.
2,633,574 A 4/1953 Dolan et al.
2,668,292 A 2/1954 Alberts
2,719,973 A 10/1955 Paula et al.
2,723,396 A 11/1955 Stack et al.
2,736,036 A * 2/1956 Sinigagliesi ..... A41B 9/04 2/405
2,787,792 A 4/1957 Mikottis et al.
2,814,805 A 12/1957 Blatt
2,816,291 A 12/1957 Blatt
2,862,502 A 12/1958 Blatt
2,878,812 A 3/1959 Geimer
2,897,823 A 8/1959 Scheinberg et al.
3,045,678 A 7/1962 Geimer et al.
3,080,869 A 3/1963 Alberts et al.
3,087,496 A 4/1963 Norman et al.
3,089,149 A 5/1963 Kelleam et al.
3,133,542 A 5/1964 Ernest et al.
3,174,482 A 3/1965 Parrott et al.
3,287,938 A 11/1966 Herbert et al.
3,328,222 A 6/1967 Ambrose et al.
3,401,699 A 9/1968 Shea et al.
3,413,824 A * 12/1968 Kuney ..... D04B 13/00 66/105
3,425,246 A 2/1969 Knohl et al.
3,431,562 A 3/1969 Souders et al.
3,487,418 A 12/1969 Jacobs et al.
3,490,449 A 1/1970 Ewerwahn
3,505,685 A 4/1970 Granchelli et al.
3,623,488 A 11/1971 Nakayama et al.
3,678,514 A * 7/1972 Safrit ..... A41B 9/08 2/212
3,703,820 A 11/1972 Jackson et al.
3,793,645 A 2/1974 Kadison
3,899,900 A 8/1975 Jackson
3,930,090 A 12/1975 Campbell, Sr. et al.
3,936,075 A 2/1976 Jelliffe
3,937,040 A * 2/1976 Negri ..... D04B 1/243 251/315.05
3,946,579 A * 3/1976 Heinig ..... A41B 9/004 66/177
4,280,229 A 7/1981 Stein
4,472,839 A 9/1984 Johansen
4,506,390 A 3/1985 Stern
4,523,337 A 6/1985 Leibowitz
4,527,402 A 7/1985 Swallow et al.
4,531,525 A * 7/1985 Richards ..... A41C 3/0014 450/65
4,557,268 A 12/1985 Maddux et al.
4,580,298 A 4/1986 Tuisl
4,596,253 A 6/1986 Griffith
4,620,326 A 11/1986 Matthias, Jr.
4,642,818 A 2/1987 Dehnert et al.
4,697,592 A 10/1987 Maddux et al.
4,746,318 A 5/1988 Moyer
4,803,740 A 2/1989 Dawson
4,839,925 A 6/1989 Panton, Jr.
4,849,863 A 7/1989 Gallegos
4,873,982 A 10/1989 Morrison
4,952,192 A 8/1990 Burke
4,976,653 A 12/1990 White
5,016,291 A 5/1991 Capper
5,052,058 A * 10/1991 Mueller ..... A41B 9/001 2/228
5,060,639 A 10/1991 Marcus
5,094,648 A 3/1992 Turner
5,144,696 A 9/1992 Kahl
5,163,184 A 11/1992 Reardon
5,280,652 A * 1/1994 Davis ..... D04B 1/106 2/239
5,283,910 A 2/1994 Flint
5,359,732 A 11/1994 Waldman et al.
5,406,964 A 4/1995 Calleja
5,416,928 A 5/1995 Koenig
5,492,496 A 2/1996 Walker
5,517,832 A * 5/1996 Kristensen ..... D04B 21/207 2/406
5,572,888 A * 11/1996 Browder, Jr. ..... D04B 1/18 2/401
5,575,011 A 11/1996 Allen
5,590,548 A * 1/1997 Osborne ..... A41B 9/04 2/401
5,611,084 A 3/1997 Garry et al.
5,623,735 A 4/1997 Perry
5,638,550 A 6/1997 Hube
5,690,122 A 11/1997 Weber-Unger
5,743,783 A 4/1998 Weber-Unger
5,746,068 A * 5/1998 Popa ..... A41D 1/06 2/213
5,787,512 A 8/1998 Knox
5,787,732 A * 8/1998 Perron ..... D04B 1/243 2/401
5,833,638 A 11/1998 Nelson
5,897,423 A 4/1999 Rosenberg
5,902,170 A 5/1999 Ganz
5,913,410 A 6/1999 Tsuchiya
5,915,531 A 6/1999 Hilpert et al.
5,946,730 A 9/1999 Blair
5,956,765 A 9/1999 Chin
5,970,526 A 10/1999 Weathers
6,000,062 A 12/1999 Trakh
6,048,253 A 4/2000 Larsen
6,054,002 A 4/2000 Griesbach, III et al.
6,061,832 A 5/2000 Morrison, Jr.
6,062,946 A 5/2000 Rosenberg
6,071,175 A 6/2000 Working, III
D427,748 S 7/2000 Shackelford
6,085,356 A 7/2000 Redmond, Sr.
6,125,664 A * 10/2000 Browder, Jr. ..... A41C 3/0014 450/92
6,146,240 A 11/2000 Morris
6,219,848 B1 4/2001 Russell
6,276,175 B1 8/2001 Browder, Jr.
6,286,152 B1 9/2001 Mooneyhan et al.
6,292,950 B1 9/2001 Mentone
6,308,338 B1 10/2001 Caldwell
6,309,369 B1 10/2001 Lebovic
6,322,529 B1 11/2001 Chung
6,550,288 B2 * 4/2003 Browder, Jr. ..... D04B 1/243 66/177
6,620,026 B1 9/2003 Guilani et al.
6,640,342 B2 11/2003 Dixon
6,672,311 B2 1/2004 Rindfleish
6,704,942 B2 3/2004 Lazarian
6,739,158 B2 5/2004 Sciacca
6,779,367 B2 * 8/2004 Mitchell ..... A41C 3/0014 450/92
6,854,132 B1 2/2005 Polzin
RE38,853 E * 10/2005 Rabinowicz ..... A41C 3/0007 450/156
7,017,376 B2 * 3/2006 Meckley ..... D04B 1/102 66/171
7,024,892 B2 * 4/2006 Blakely ..... A41B 11/005 66/177
7,048,013 B2 * 5/2006 Shannon ..... A41B 9/001 139/421
7,051,557 B2 * 5/2006 Mitchell ..... A41C 3/0014 450/92
7,181,775 B2 * 2/2007 Carney ..... A41D 1/21 2/311
7,260,961 B1 * 8/2007 Kennedy ..... D04B 1/243 66/171
D552,328 S 10/2007 Smith et al.
7,441,418 B2 * 10/2008 Delgado-Mecinas .... A41B 9/00 66/169 R

(56) References Cited

U.S. PATENT DOCUMENTS

| | | | | |
|---|---|---|---|---|
| 7,676,852 | B1 | 3/2010 | Carney | |
| 7,814,575 | B2 | 10/2010 | Hendrickson et al. | |
| 7,900,276 | B2 | 3/2011 | Hendrickson et al. | |
| D644,412 | S | 9/2011 | Reuther | |
| 8,123,590 | B2 * | 2/2012 | MacKinnon | A41B 11/003 2/228 |
| 8,191,177 | B1 | 6/2012 | Carney | |
| 8,276,216 | B2 * | 10/2012 | Carney | A41D 1/21 2/311 |
| 2002/0002405 | A1 | 1/2002 | Janusson et al. | |
| 2002/0108164 | A1 | 8/2002 | Dixon | |
| 2002/0152775 | A1 * | 10/2002 | Browder, Jr. | A41B 9/001 66/170 |
| 2004/0049834 | A1 | 3/2004 | Stangle et al. | |
| 2004/0163159 | A1 | 8/2004 | Edwards et al. | |
| 2004/0210987 | A1 | 10/2004 | Carney | |
| 2005/0014451 | A1 | 1/2005 | Wicks | |
| 2005/0027219 | A1 | 2/2005 | Schultze et al. | |
| 2005/0115281 | A1 | 6/2005 | Mitchell et al. | |
| 2006/0010571 | A1 | 1/2006 | Oakley | |
| 2006/0021388 | A1 * | 2/2006 | Mitchell | A41C 3/0014 66/176 |
| 2007/0118062 | A1 | 5/2007 | Fleck | |
| 2007/0186325 | A1 | 8/2007 | Torrent Lopez et al. | |
| 2008/0172769 | A1 | 7/2008 | Herget | |
| 2009/0049583 | A1 | 2/2009 | Stones | |
| 2010/0000004 | A1 | 1/2010 | Levac et al. | |
| 2010/0235965 | A1 | 9/2010 | Frandsen et al. | |
| 2011/0059678 | A1 | 3/2011 | Agassi et al. | |
| 2011/0061147 | A1 | 3/2011 | Welfeld | |
| 2011/0230119 | A1 | 9/2011 | Thompson | |
| 2011/0239353 | A1 | 10/2011 | Carney | |

FOREIGN PATENT DOCUMENTS

| | | | |
|---|---|---|---|
| EP | 769254 | A2 | 1/1998 |
| EP | 1031292 | A2 | 8/2000 |
| JP | 1148802 | | 6/1989 |
| JP | 8089521 | | 4/1996 |
| JP | 10-266002 | A | 10/1998 |
| JP | 2002088518 | A | 3/2002 |
| JP | 2002317311 | A | 10/2002 |
| NZ | 337903 | | 9/1999 |

OTHER PUBLICATIONS

My Ties, Cotton stretch tube top. Accessed from: http://www.mytiesarongs.com/tubetops.htm, Mar. 2001.
"Belts Make the Silhouette". The Notion and Novelty Review, Aug. 1936, p. 32.
Belly Belt, Maternity Wear Solution, Motherhood Maternity, www.motherhood.com, Australia.
"Clothes of the Eighties, Clothes beginning with U." Units description. Accessed from: www.inthe80s.com, Jun. 2, 2002.
www.neatrags.com/fashionshow.htm, Multiples photos and descriptions, Accessed Mar. 6, 2000.
Norwich, William. Article from New York Observer, Apr. 12, 1999, "Struggling for a Fashion-Forward Pregnancy", p. 26, with abstract showing date of publication.
Kiabi, description and view of Bandeau Mater (maternity belt), print from kiabi.com website, 2001, with English translation, two pages.
Declaration of Angela Mavridis, 7 pages, Aug. 1, 2006.
Declaration of Sarah Pollak, 4 pages, Aug. 1, 2006.
Declaration of Shannon DiPadova, 4 pages, Jul. 31, 2006.
Plaintiff Ingrid Carney and Ingrid & Isabel, Inc.'s Opening Claim Construction Brief, *Carney et al.* v. *Mothers Work, Inc.* (N.D. Cal. C07-1153 JCS) (Jan. 18, 2008).
Defendant Mothers Work, Inc.'s Preliminary Invalidity Contentions (Patent L.R. 3-3 and 3-4), *Carney et al.* v. *Mothers Work, Inc.* (N.D. Cal. C07-1153 JCS), Sep. 21, 2007.
Declaration of Gregory R. Stangle (with Exhibits A-M), Sep. 21, 2007.
Deposition of Gregory Stangle, *Carney et al.* v. *Mothers Work, Inc.* (N.D. Cal. C07-1153 JCS), Sep. 13, 2007.
Kershaw, Sydney Morning Herald, "Pregnancy Gives Birth to 'Belter' of a Product", Mar. 16, 2002.
Millard, The Independent (London), "Style: Big News from the Front", Apr. 25, 1997.
Brinley, "Maternity Style: How to Look your Best when you're at your Biggest", St. Martin's Press, New York, 1985.
Sutherland, "Pregnant and Chic", Workman Publishing, New York, 1989.
Fendel, "Waiting in Style", Acropolis Books, Ltd., Washington D.C., 1983.
Serota et al., "Pregnancy Chic: The Fashion Survival Guide", Villard Books, New York, 1998.
Callan, "The Thames and Hudson Dictionary of Fashion and Fashion Designers" (belt), Thames & Hudson, Inc., New York, 1998.
Tortora, "Encyclopaedia of Accessories" (belts), Fairchild Publications, Inc., New York, 2003.
Declaration of Ingrid Carney under 37 CFR §1.131 (with Exhibits A-C6), Feb. 8, 2005.
Claim Construction Order for U.S. Pat. No. 7,181,775, dated Apr. 3, 2009, 13 pages.
Counterclaimant Baby Be Mine, LLC's Responsive Claim Construction Brief, *Ingrid & Isabel, Inc.* v. *Baby Be Mine, LLC* (N.D. Cal. CV-08-02554 JCS), Feb. 25, 2009.
Mothers Work's Responsive Claim Construction Brief, *Ingrid Carney* v. *Mothers Work, Inc.* (N.D. Cal. C07 1153 JCS), Feb. 1, 2008.
Ingrid & Isabel, Inc.'s Opening Claim Construction Brief, *Ingrid & Isabel Inc.* v. *Baby Be Mine, LLC* (N.D. Cal. C08-02554), Dec. 22, 2008.
Ingrid & Isabel, Inc.'s Reply Brief in Support of Claim Construction, *Ingrid & Isabel Inc.* v. *Baby Be Mine, LLC* (N.D. Cal. C08-02554), Mar. 2, 2009.
Plaintiffs Reply Brief on Claim Construction, *Ingrid Carney and Ingrid & Isabel, Inc.* v. *Mothers Work, Inc.* (N.D. Cal. C07-1153 JCS), Feb. 8, 2008.
Stipulated Order and Consent Judgment, *Ingrid Carney and Ingrid & Isabel, Inc.* v. *Mothers Work, Inc.* (N.D. Cal. C07-1153 JCS), May 16, 2008.
Claim Construction Order, *Ingrid & Isabel Inc.* v. *Baby Be Mine, LLC* (N.D. Cal. C08-02554), Apr. 3, 2009.
Ho Sin Man, "Maternity Garment Treatment for the Relief of Low Back Pain" Phil. D Thesis. Hong Kong Polytechnic University [Online] 2008, 243 pages.
Office Action, dated dec. 8, 2003, U.S. Appl. No. 10/423,224, filed Apr. 25, 2003.
Office Action, dated Nov. 23, 2004, U.S. Appl. No. 10/423,224, filed Apr. 25, 2003.
Office Action, dated Sep. 23, 2005, U.S. Appl. No. 10/423,224, filed Apr. 25, 2003.
Notice of Allowance, dated Apr. 6, 2006, U.S. Appl. No. 10/423,224, filed Apr. 25, 2003.
Office Action, dated Jun. 22, 2006, U.S. Appl. No. 10/423,224, filed Apr. 25, 2003.
Notice of Allowance, dated Aug. 9, 2006, U.S. Appl. No. 10/423,224, filed Apr. 25, 2003.
Office Action, dated Nov. 16, 2007, U.S. Appl. No. 11/435,492, filed May 16, 2006.
Office Action, dated Aug. 6, 2008, U.S. Appl. No. 11/435,492, filed May 16, 2006.
Office Action, dated Apr. 29, 2009, U.S. Appl. No. 11/435,492, filed May 16, 2006.
Final Office Action, dated Jul. 13, 2009, U.S. Appl. No. 11/435,492, filed May 16, 2006.
Advisory Action, dated Oct. 16, 2009, U.S. Appl. No. 11/435,492, filed May 16, 2006.
Notice of Allowance, dated Dec. 18, 2009, U.S. Appl. No. 11/435,492, filed May 16, 2006.
Notice of Allowance, dated Jan. 15, 2010, U.S. Appl. No. 11/435,492, filed May 16, 2006.
Office Action, dated Nov. 15, 2011, U.S. Appl. No. 13/166,789, filed Jun. 22, 2011.

(56) References Cited

OTHER PUBLICATIONS

Office Action, dated Nov. 16, 2011, U.S. Appl. No. 12/697,144, filed Jan. 29, 2010.
Final Office Action, dated Dec. 20, 2011, U.S. Appl. No. 13/166,789, filed Jun. 22, 2011.
Final Office Action, dated Feb. 24, 2012, U.S. Appl. No. 12/697,144, filed Jan. 29, 2010.
Advisory Action, dated Mar. 26, 2012, U.S. Appl. No. 12/697,144, filed Jan. 29, 2010.
Notice of Allowance, dated Apr. 11, 2012, U.S. Appl. No. 12/697,144, filed Jan. 29, 2010.
Advisory Action, dated Apr. 27, 2012, U.S. Appl. No. 13/166,789, filed Jun. 22, 2011.
Office Action, dated May 18, 2012, U.S. Appl. No. 13/166,789, filed Jun. 22, 2011.
Final Office Action, dated Jun. 26, 2012, U.S. Appl. No. 13/166,789, filed Jun. 22, 2011.
Notice of Allowance, dated Jul. 26, 2012, U.S. Appl. No. 13/166,789, filed Jun. 22, 2011.
Notice of Allowance, dated Aug. 1, 2012, U.S. Appl. No. 13/166,789, filed Jun. 22, 2011.

* cited by examiner

INSIDE VIEW – OPTION 1

INSIDE VIEW – OPTION 2

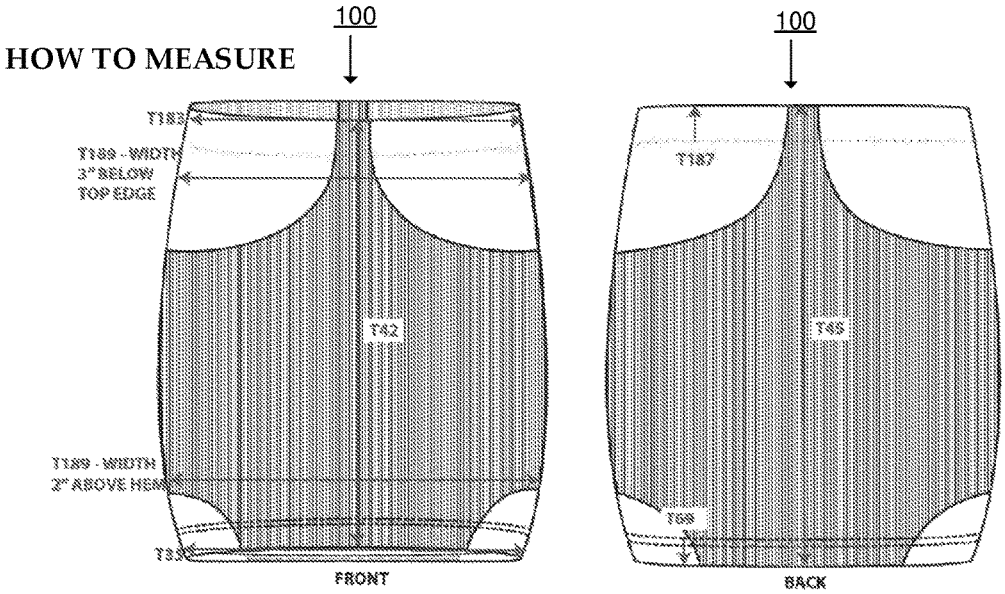
FIG. 4A
FIG. 4B
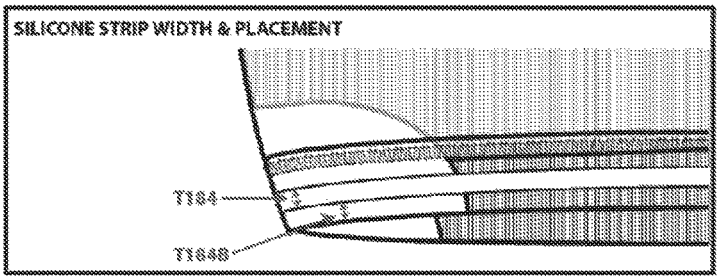
FIG. 4C

| Style Part | Component - Description | Type |
|---|---|---|
| BODY | INF099-92% Nylon 8% Spandex Seamless Compression | FABRIC |
| CLOSING SEAM | INT005-SEWING THREAD | TRIM |
| BOTTOM HEM | INT200-TBD SILICON STRIP | TRIM |
| TBC | INT019-TBD Heat Transfer - Ingrid & Isabel | LABELS AND ARTWORK |

FIG. 6

| POM | DESCRIPTION | POSITION | TOL - | TOL + | S | M | L |
|---|---|---|---|---|---|---|---|
| T183 | Body - Width at Top | | -3/8 | 3/8 | 9 1/2 | 10 3/4 | 12 |
| T189 | Width | 3" BELO W TOP EDGE | -3/8 | 3/8 | 9 5/8 | 10 7/8 | 12 1/8 |
| T189 | Width | 2" ABOVE HEM | -3/8 | 3/8 | 9 | 10 | 11 |
| T35 | Sweep - Relaxed | | -3/8 | 3/8 | 10 | 11 | 12 |
| T187 | Hem - Top Hem Height | | -1/8 | 1/8 | 1 3/4 | 1 3/4 | 1 3/4 |
| T69 | Bottom Hem Height | TO STITC HING | -1/8 | 1/8 | 1 1/8 | 1 1/8 | 1 1/8 |
| T42 | CF Length^ | | -3/8 | 3/8 | 10 1/4 | 10 1/4 | 10 1/4 |
| T45 | CB Length | | -3/8 | 3/8 | 10 1/4 | 10 1/4 | 10 1/4 |
| T184 | Silicone Strip - Width | | 0 | 0 | 5/8 | 5/8 | 5/8 |
| T184B | Silicone Strip - Placement | FROM EDGE | -1/16 | 1/16 | 5/16 | 5/16 | 5/16 |

FIG. 7

SEAMLESS POSTPARTUM GARMENT

FIELD OF THE INVENTION

This invention relates generally to apparel, and more specifically to a stretchable garment that is suited for the unique needs of a postpartum woman while her body is in transition post-pregnancy. The garment is configured to provide compression and comfort while the woman's body changes.

BACKGROUND OF THE INVENTION

After giving a birth, a woman's abdomen is generally still extended and some time is needed for the body to recover and return to normal size. Various products exist that purport to help shrink a woman's abdomen. However, these products are not made in a manner to be functional and comfortable for extended wear over many hours.

Thus, a solution is needed for a stretchable garment that can be worn by a woman during her body's postpartum phase that assists in shrinking the body back to normal size while also being comfortable.

SUMMARY OF THE INVENTION

Disclosed herein are various embodiments of a seamless postpartum garment. In exemplary embodiments, the postpartum garment is manufactured from a seamless double layer circular knit tube having an inner layer and an outer layer. The outer layer is manufactured using at least two different knit structures at different portions of the garment, the knit structures providing compression, lift, and support at strategic locations on a woman's postpartum body. Similarly, the inner layer is manufactured using at least two different knit structures at different portions of the garment, the knit structures providing compression, lift, and support at strategic locations on a woman's postpartum body.

BRIEF DESCRIPTION OF THE DRAWINGS

Embodiments are illustrated by way of example, and not by limitation in the figures of the accompanying drawings, in which like references indicate similar elements.

FIGS. 4A-4D depict various measurement metrics for an exemplary seamless postpartum garment.

FIG. 6 is a table depicting exemplary components of a seamless postpartum garment.

FIG. 7 is a table depicting measurements for the exemplary seamless postpartum garments depicted in FIGS. 4A-D.

DETAILED DESCRIPTION

Figures 1A, 1B:
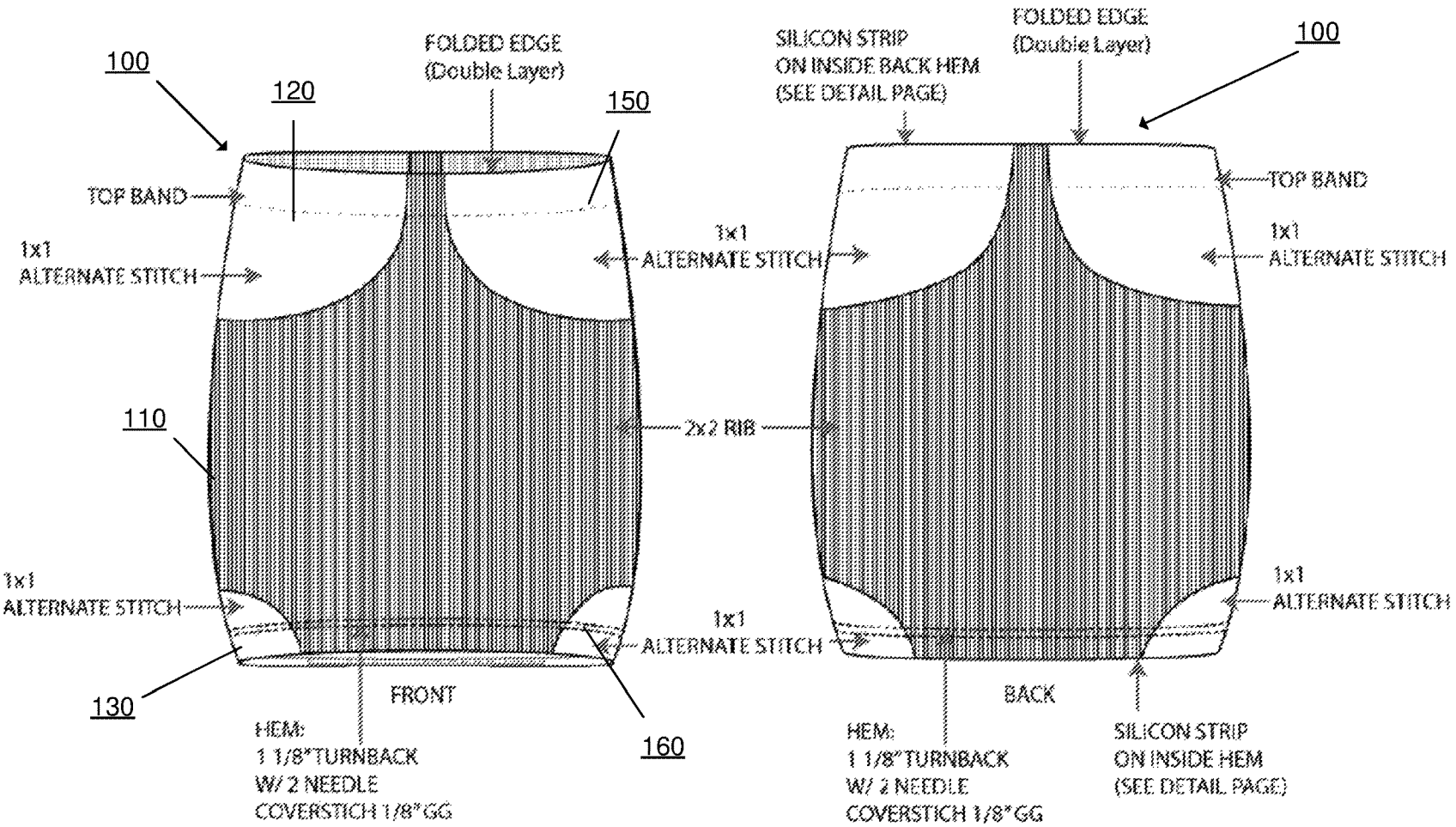
FIG. 1A is a front view of an exemplary embodiment of a seamless postpartum garment.
FIG. 1B is a back view of an exemplary embodiment of a seamless postpartum garment.

The following detailed description includes references to the accompanying drawings, which form a part of the detailed description. The drawings show illustrations, in accordance with exemplary embodiments. These exemplary embodiments, which are also referred to herein as "examples," are described in enough detail to enable those skilled in the art to practice the present subject matter. The embodiments can be combined, other embodiments can be utilized, or structural, logical, and electrical changes can be made without departing from the scope of what is claimed. The following detailed description is therefore not to be taken in a limiting sense, and the scope is defined by the appended claims and their equivalents. In this document, the terms "a" and "an" are used, as is common in patent documents, to include one or more than one. In this document, the term "or" is used to refer to a nonexclusive "or," such that "A or B" includes "A but not B," "B but not A," and "A and B," unless otherwise indicated.

After a woman gives birth, some time is needed for the body to heal and reduce back to normal size. Various products exist that purport to assist a woman in shrinking her abdomen, but they are not very convenient or easy to use/wear for extended periods of time. These other products may take the form of various belts or standalone waist bands, but generally have adjustable fasteners such as Velcro, hook and eye mechanisms, leather straps, etc. They may also be manufactured from multiples of fabric that perform in different ways or different materials that enhance the performance like a rubber band.

The presently disclosed seamless postpartum garment is made from a single seamless double layer knit tube with varying knit structures built into the garment. By providing a seamless garment, comfort is enhanced for the wearer, allowing the woman to wear the garment for extended periods of time. The garment may be worn directly against the wearer's skin, over undergarments, or over an outer garment like pants.

During pregnancy a woman needs support and lift for her expanding belly. However, in the postpartum phase, the woman needs assistance pushing the belly inward and downward so she can return to her pre-pregnancy shape. The garment described herein provides for this unique need of a woman during the postpartum phase, to assist her in regaining her previous shape.

While the garment is disclosed herein as being worn by a woman during postpartum phase, women of all shapes and sizes may use the garment at any other time as well, regardless of pregnancy, for the comfort, support, and compression provided by the seamless manufacture of the garment.

In exemplary embodiments, the garment may be a standalone garment, or may be attached to another undergarment, such as a panty or a brassiere.

How it's Worn

In exemplary embodiments, the garment is worn by a woman substantially over the abdomen. It may extend from just under the bust of the woman (lower trunk), to over the hip. The compression aspect of the garment helps push out air and unwanted leftovers from the inside of the woman's abdomen after childbirth. The seamless construction facilitates the compression properties of the garment without interruption, and also allows the woman to feel more comfortable while wearing the garment.

Material of Garment

The seamless postpartum garment is manufactured from a flexible, stretchable material, allowing it to adjust to a woman's changing body shape in the weeks after she gives birth.

In various embodiments, the garment is composed of nylon and spandex, in basic colors typical of undergarments, such as black, nude, grey, and white. The garment can also be made from various patterns, colors, or design prints if desired. The garment may also be textured or adorned with any decoration known in the art such as lace, beads, or decorative stitching.

The knit fabrics discussed herein may be any knit fabric known in the art such as double knit fabric, single knit fabric, baby rib knit, interlock knit, pique knit, jersey knit, or textured novelty knit. In one embodiment, the knit fabric is jersey fabric. The garment may be seamless and of a stretchable, knit nylon/spandex (elastane) blend. The knit fabric nylon/spandex blend may include 87-97% nylon and an inverse amount of spandex (3-13%). For example, the nylon/spandex blend may include 92% nylon and 8% spandex, or any other combination in the range. In other embodiments, the garment may be made of other suitable fabrics known in the art such as polyester, lyocell, rayon, polyamide, cotton, organic cotton, or viscose, among others, in combination with or instead of the above listed fabrics.

In various embodiments the main body of the garment may be made from one material while one or more panels are constructed from a different material.

Knit Structures and Seamless Compression

Seamless compression allows for different knit textures and knit performance textures of the garment by creating hills and valleys with the knitting yarn at certain strategic locations on the garment, in the manufacturing process. The different knit constructions are utilized for different purposes in various strategic locations of the garment, to assist with compression and performance of the garment while maintaining comfort for the wearer. The knit structures create specific pressure of force per inch, and these are strategically knitted into specific locations of the garment, such that when the garment is worn by a woman, the knit structures are placed over specific regions of the woman's body.

Garment Shape

Exemplary embodiments of the garment are shown in FIGS. 1-5. The garment 100 is manufactured in a shape that is substantially cylindrical. However, it is made to hug the female body without being a strict basic cylinder. For example, the top hem 150 may be less wide than the bottom hem 160 because a woman's hips are typically wider than her natural waist, especially after childbirth.

In the exemplary embodiment depicted in FIGS. 1A and 1B, the garment consists of a main body 110, upper symmetrical panels 120, and lower symmetrical panels 130. The main body 110 of the garment 100 is shown in vertical stripe as being constructed using a 2×2 rib knit structure. There are upper symmetrical panels 120 on the top left and right side of the garment, and smaller lower symmetrical panels 130 on the bottom left and right side of the garment. In other embodiments, the upper symmetrical panels 120 and lower symmetrical panels 130 may be of substantially the same size. Also, as depicted in FIGS. 1A and 1B, the panels may wrap around the wearer from the front to the back.

The panels 120 and 130 can be made using a different knit structure of the same fabric as the main body 110 of the garment 100, and/or from different fabric than the main body 110 of the garment 100. In exemplary embodiments, the panels 120 and 130 are manufactured using a 1×1 knit structure, while the main body 110 is manufactured using a 2×2 knit structure. The use of the different knit structures on different locations of the garment allows the garment to apply gentle continuous compression at strategic locations on the woman's body while she is wearing the garment. In particular, the compression and knit tension perform in such a way to enhance user comfort and experience by providing even pressure generally on the body of the wearer with support spread throughout the muscle tissues. Thus, by using different knit structures strategically, fabric material capabilities are used strategically, and can provide gentle pushing inward and upward on the belly without being uncomfortable for the wearer.

In exemplary embodiments, the main body 110 of the garment may have rib knit (jersey, knit texture). Rib knits have mechanical stretch produced by hills and valleys in the yarn, which allow the garment to be more comfortable for the wearer. The panels 120 and 130 on the garment may be of a flat knit structure and thus have more compression and less stretch. The strategic positioning of these panels forces compression down the extended belly of the wearer and provides even pressure under the bust. This keeps excess air from the abdomen from traveling north. The larger upper symmetrical panels 120 on the top of the garment assist in pushing the belly inwards and downwards from above. The lower symmetrical panels 130 on the bottom of the garment may be constructed from the same or different knit structure as the upper symmetrical panels 120. The panels 120 and 130 may also assist in keeping the garment taut around the woman's body so it remains in place while the woman moves around during the day.

In the exemplary embodiments depicted in FIGS. 1A and 1B, a top band portion of the garment 100 is defined by top hem 150, and a bottom band portion of the garment 100 is defined by bottom hem 160.

Figures 2A, 2B:
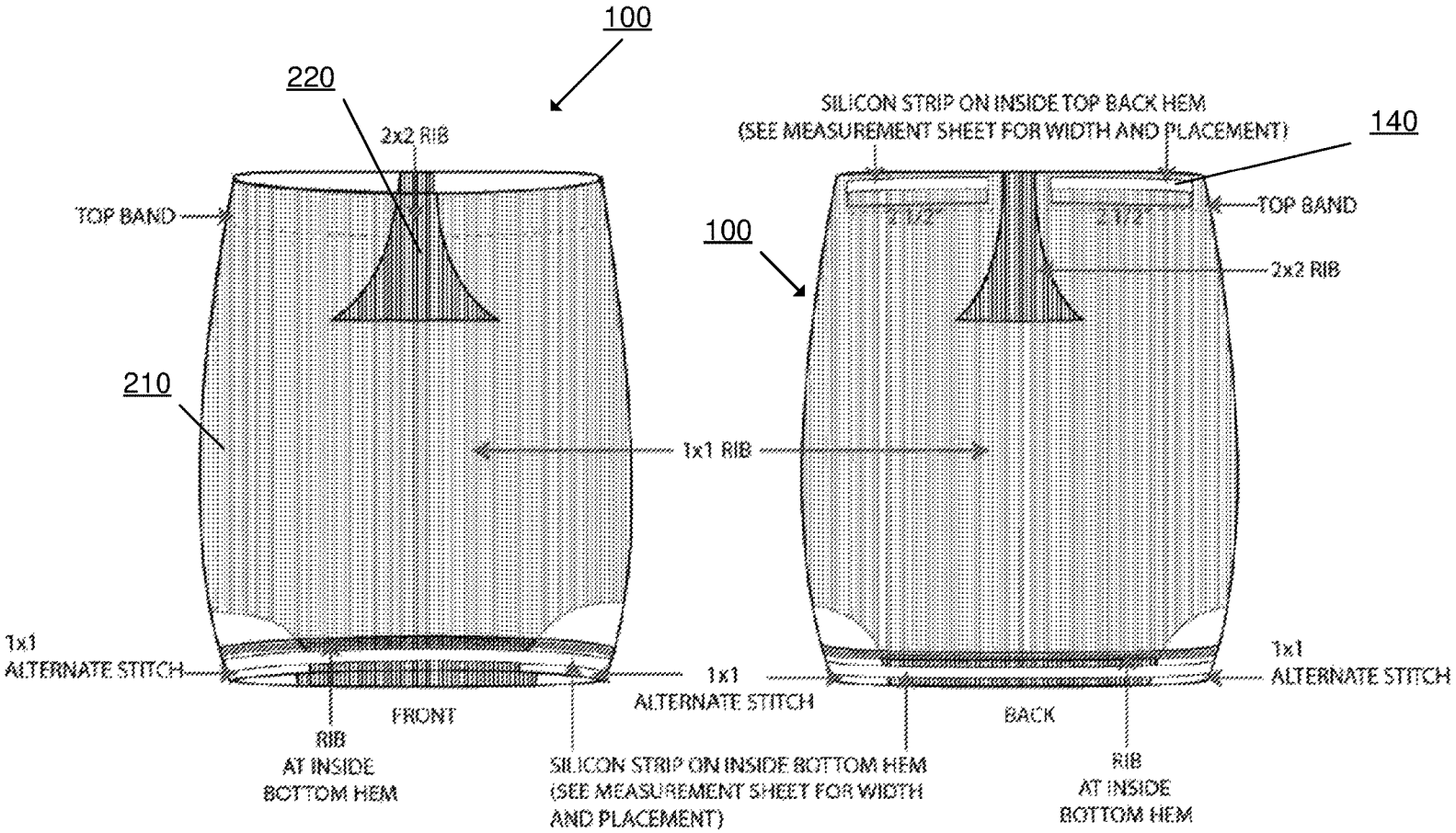
FIG. 2A is an inside view of the front of an exemplary embodiment of a seamless postpartum garment.
FIG. 2B is an inside view of the back of an exemplary embodiment of a seamless postpartum garment.

FIGS. 2A and 2B depict exemplary inside views of a garment 100. In the inside view, the inner layer of the seamless double layer circular knit tube may be manufactured using different knit structures than present in the outer layers depicted in FIGS. 1A and 1B. For example, the main body of the inner layer 210 may be manufactured from a substantially 1×1 rib knit structure, while a substantially triangular portion 220 may be manufactured using a 2×2 rib knit structure. The use of the different knit structures allows different amounts of compression and pressure to be applied at strategic locations on the wearer's body. Furthermore, the use of different knit structures in the inner layer and outer layers of the double layer circular knit tube further allows for strategic compression and lift at strategic locations on the wearer's body. In other embodiments, the inner layer main body and outer layer main body may be manufactured using substantially the same knit structure.

Additionally, one or more thin silicone strips 140 may be placed near the top hem 150 and/or bottom hem 160 on the inside binding to keep the garment in its true location, like a grip. The silicone strip 140 may be placed in strategic areas on the front side (not depicted) and/or back side to assist the garment in staying in one place while the wearer moves throughout the day, without sacrificing comfort. In this way, the garment is specially designed inside and out for a woman in the postpartum phase.

Figures 3A, 3B:
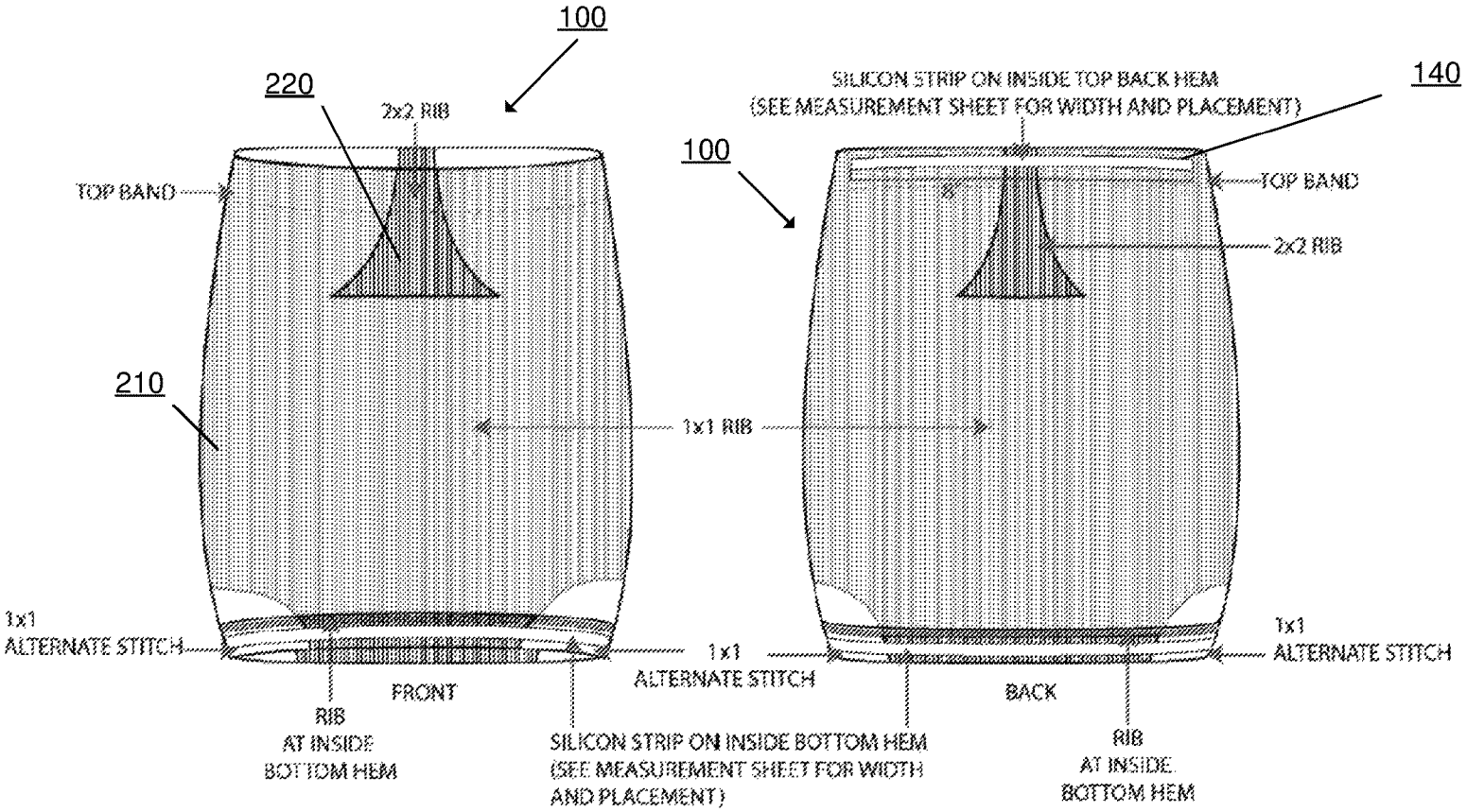
FIG. 3A is an inside view of the front of another exemplary embodiment of a seamless postpartum garment.
FIG. 3B is an inside view of the back of another exemplary embodiment of a seamless postpartum garment.
Figure 4D:
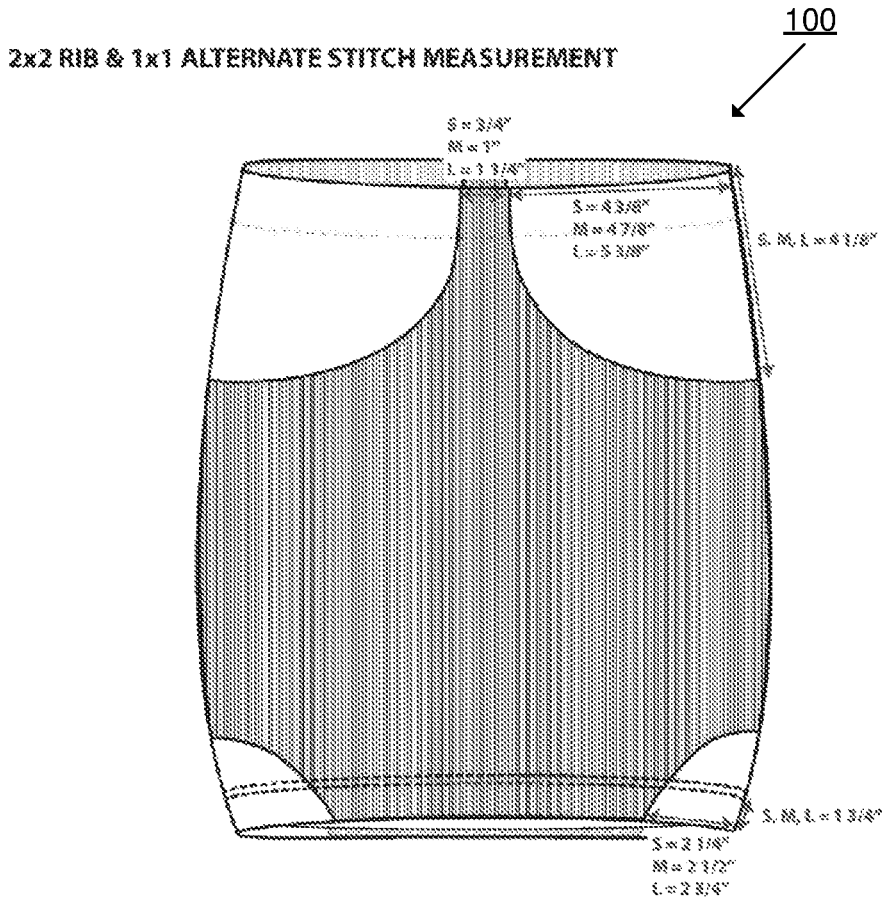

FIGS. 3A and 3B depict an alternate embodiment of inside views of the garment 100. The inner layer of the double layer circular knit tube may be manufactured substantially like that in FIGS. 2A and 2B, with the exception of the silicone strip 140 near the top hem 150 being a singular long strip placed on the back side and/or front side (not depicted), instead of multiple smaller strips of silicone. This silicone strip aids in keeping the garment 100 in place on the body of the wearer while she moves throughout the day.

FIGS. 4A-4D depict different measurements that can be taken of the garment 100 for different sizes, and FIG. 7 depicts sample measurements for the markers shown in FIGS. 4A-4D. FIG. 6 depicts exemplary materials for parts of the garment 100.

Figure 5:
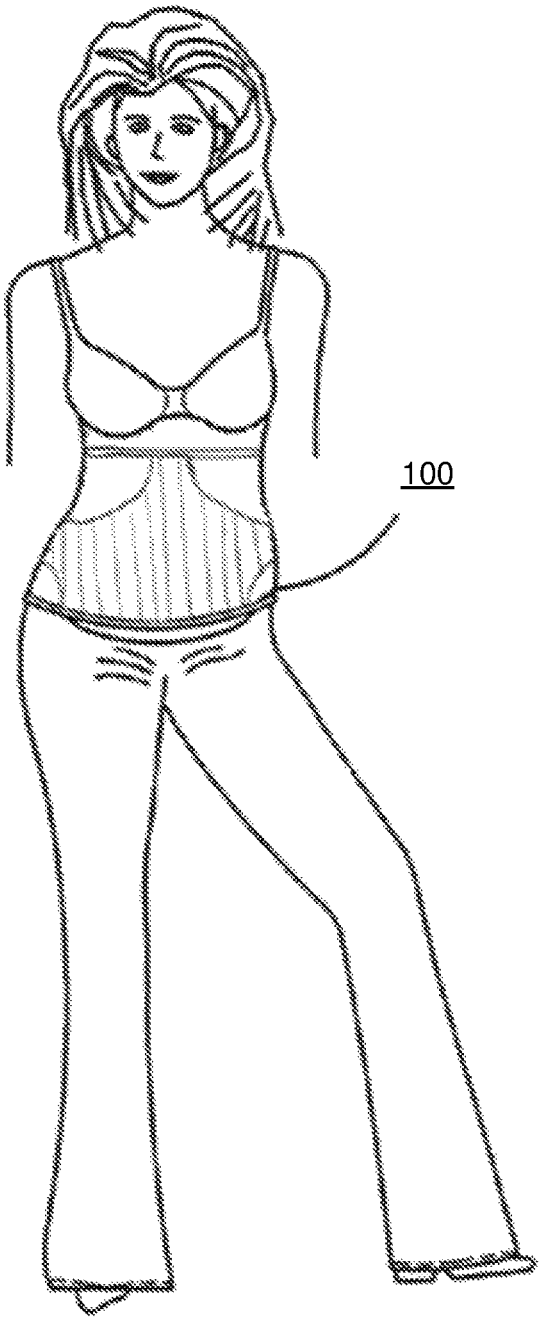
FIG. 5 is a front view of a woman wearing a seamless postpartum garment.

FIG. 5 depicts an exemplary view of a woman wearing the garment 100.

Manufacturing

In exemplary embodiments, a circular knitting machine is used to manufacture the garment 100. The garment 100 may be manufactured from a single piece of circularly knitted fabric such as a single knit or double knit.

In various embodiments, the garment is manufactured using an electronic circular knitting machine or electronic warp knitting machine for seamless products, such as the single jersey, double jersey, or warp seamless machines produced by Santoni S.p.A. of Brescia, Italy. Knitting machines made by other manufacturers may also be used, such as machines made by Sangiacomo, Maeyer & Cie, Terrot, Fukuhara, Pilotelli and Jumberca, among others. The knitting machine may have a cylinder having various shapes and properties. The cylinder may also allow the use of different fabrics, yarn types, needles, and knitting structures.

The presently disclosed garment may be manufactured from a seamless double layer circular knit tube. The double layer tube has an outer layer and an inner layer. The garment may be manufactured from a single piece of circularly knitted fabric that is folded over to create inner and outer layers, or from two pieces of circularly knitted fabric tubes that are placed inside one another to create inner and outer layers. In exemplary embodiments, the garment is manufactured from one seamless double layer circular knit fabric tube. This circular tube structure of flexible material allows for the garment to continuously pull inwards which provides compression at strategic locations on the postpartum abdomen.

The garment is made from stretchable material, and can be designed such that one size fits most users, although different sizes may also be provided if desired, for different sized women. Sizes may be designated by numbers, letters, or any other suitable designation. For example, sizes may be designated as small (S), medium (M), large (L), or extra large (XL).

The flexible, stretchable material of garment 100 may have a weight (also referred to as fabric density) ranging from 190 grams/square meter to 330 grams/square meter.

Optionally, garment 100 has finishing around the top and/or bottom edges, and/or any other portion where fabric was removed from the seamless circular knit tube. The finishing may include elastic binding of varying sizes, such as 0.25 inch foldover elastic binding.

The above described embodiments are intended to illustrate the principles of the invention, but not to limit its scope. Other embodiments and variations to these embodiments will be apparent to those skilled in the art and may be made without departing from the spirit and scope of the invention as defined in the following claims. It will be further understood that the methods of the invention are not necessarily limited to the discrete steps or the order of the steps described. To the contrary, the present descriptions are intended to cover such alternatives, modifications, and equivalents as may be included within the spirit and scope of the invention as defined by the appended claims and otherwise appreciated by one of ordinary skill in the art.

What is claimed is:

1. A postpartum garment that is configured to be worn around an abdomen of a woman, the garment comprising:

a circular knit tube configured to be worn around the abdomen of a woman, the circular knit tube constructed with:

at least two different knit structures at varying locations on the circular knit tube, wherein placement of the different knit structures on the circular knit tube provides compression at strategic locations on the woman's body, the circular knit tube further comprising:

a first horizontal terminal end configured to be placed around the abdomen of the woman below a bust and above a navel of the woman's body;

a second horizontal terminal end configured to be placed around the abdomen of the woman below the navel of the woman's body; and an outer layer comprising:

a main body of the outer layer of the circular knit tube;

two discrete upper panels on the outer layer of the circular knit tube, each of the two discrete upper panels mating with the first horizontal terminal end of the circular knit tube, and each of the two discrete upper panels constructed with a different knit structure than the main body of the outer layer of the circular knit tube; and two discrete lower panels on the outer layer of the circular knit tube, each of the two discrete lower panels mating with the second horizontal terminal end of the circular knit tube, and each of the two discrete lower panels constructed with a different knit structure than the main body of the outer layer of the circular knit tube.

2. The garment of claim 1, wherein the circular knit tube is a double layer circular knit tube.

3. The garment of claim 1, wherein the circular knit tube is a seamless circular knit tube.

4. The garment of claim 2, wherein a main body of an inner layer of the double layer circular knit tube is of a different knit structure than the main body of the outer layer of the double layer circular knit tube.

5. The garment of claim 1, wherein at least one of the at least two different knit structures is a 1×1 rib knit.

6. The garment of claim 1, wherein at least one of the at least two different knit structures is a 2×2 rib knit.

7. The garment of claim 1, wherein the circular knit tube is composed of a blend of nylon and spandex.

8. The garment of claim 1, wherein the circular knit tube is composed of 92% nylon and 8% spandex.

9. The garment of claim 1, wherein the circular knit tube is composed of a single fabric.

10. The garment of claim 1, wherein the circular knit tube is composed of two different fabrics.

11. The garment of claim 1 further comprising at least one silicone strip near a top hem of an inner layer of the circular knit tube, configured to hold the circular knit tube in place on the woman's body.

12. The garment of claim 1 further comprising at least one silicone strip near a bottom hem of an inner layer of the circular knit tube, configured to hold the circular knit tube in place on the woman's body.

13. The garment of claim 1, wherein the first horizontal terminal end of the circular knit tube is of a smaller circumference than the second horizontal terminal end of the circular knit tube.

14. A postpartum garment that is configured to be worn around an abdomen of a woman, the garment comprising:

a circular knit tube configured to be worn around the abdomen of a woman, the circular knit tube constructed with:

at least two different knit structures at varying locations on the circular knit tube, wherein placement of the different knit structures on the circular knit tube provides compression at strategic locations on the woman's body, the circular knit tube further comprising:

a first horizontal terminal end configured to be placed around the abdomen of the woman below a bust and above a navel of the woman's body;

a second horizontal terminal end configured to be placed around the abdomen of the woman below the navel of the woman's body; and an inner layer of the circular knit tube that has a substantially triangular portion mating with the first horizontal terminal end of the circular knit tube, the substantially triangular portion having a bottom edge that is wider than a top edge, and the substantially triangular portion constructed with a different knit structure than a main body of the inner layer of the circular knit tube.

15. The garment of claim 14, wherein the circular knit tube is a double layer circular knit tube.

16. The garment of claim 14, wherein the circular knit tube is a seamless circular knit tube.

17. The garment of claim 15, wherein the main body of the inner layer of the double layer circular knit tube is of a different knit structure than a main body of an outer layer of the double layer circular knit tube.

18. The garment of claim 14, wherein at least one of the at least two different knit structures is a 1×1 rib knit.

19. The garment of claim 14, wherein at least one of the at least two different knit structures is a 2×2 rib knit.

20. The garment of claim 14, wherein the circular knit tube is composed of a blend of nylon and spandex.

* * * * *